United States Patent [19]

Stambaugh et al.

[11] 4,055,400

[45] Oct. 25, 1977

[54] EXTRACTING SULFUR AND ASH

[75] Inventors: Edgel P. Stambaugh, Worthington, Ohio; George F. Sachsel, Boulder, Colo.

[73] Assignee: Battelle Memorial Institute, Columbus, Ohio

[21] Appl. No.: 565,454

[22] Filed: Apr. 7, 1975

Related U.S. Application Data

[63] Continuation-in-part of Ser. No. 382,536, July 25, 1973, abandoned.

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 44,817 | 10/1864 | Penniman | 44/1 R |
| 1,007,153 | 10/1911 | Spurrier | 44/1 R |
| 2,162,221 | 6/1939 | Kasehagen et al. | 44/1 R |

*Primary Examiner*—Carl F. Dees

*Attorney, Agent, or Firm*—Philip M. Dunson; C. Henry Peterson

[57] ABSTRACT

A method of extracting a substantial proportion of the pyritic, organic, and sulfate sulfur compounds and ash present in a solid carbonaceous fuel of the coal or coke type comprising mixing the fuel with an aqueous alkaline solution containing a sodium, calcium, or ammonium carbonate, hydroxide, sulfide, or hydrosulfide, or a plurality thereof, heating the resulting mixture to at least about 125° C at a pressure of at least about 25 psig to leach out the sulfur compounds and ash, separating the easily removable leached out materials from the remainder of the fuel, and washing said remainder of the fuel. The concentration of alkali in the solution typically is about 1 to 35 percent by weight, and the mixture typically is heated for at least about 5 minutes at about 350° C, about 1 hour at 300° C, about 2 hours at 250° C, about 4 hours at 200° C, about 10 hours at about 125° C, or for at least a time approximately proportionately between the foregoing times at an intermediate temperature. The pressure may be provided at least in part by oxygen, hydrogen, nitrogen, oxygen plus nitrogen, or hydrogen plus nitrogen.

18 Claims, No Drawings

EXTRACTING SULFUR AND ASH

RELATED APPLICATION

This is a continuation in part of U.S. patent application Ser. No. 382,536, filed July 25, 1973, now abandoned.

BACKGROUND

An alternative to combat air pollution resulting from the combustion of fossil fuels is to remove the pollutants prior to combustion and thus burn a clean fuel. The problem is to produce a "clean" fuel, i.e., a fuel containing low sulfur, low nitrogen, and low ash values. This invention relates to a new and improved process for producing such a clean fuel.

A primary object of the present invention is to provide a process for producing a clean coal which can be used as fuel with minimal pollution control and as a raw material for the production of gaseous and liquid fuels by gasification and liquefaction.

This invention can enhance the usefulness of coal as a contributor to the energy requirements of the United States and greatly reduce the pollution of our environment. The clean coal can be not only a source of solid fuel but also a raw material for the production of gaseous and liquid fuels. Pollution of the environment with sulfur and nitrogen oxides and toxic metals from the combustion of coal can be greatly reduced as a result of their removal from the coal prior to combustion. Furthermore this invention will alleviate the dependence of the United States on foreign sources of energy and also alleviate the energy crisis the United States is now facing.

Coal is the major source of energy for the United States and will continue to be for many years. However, one of the problems with coal as the source of energy is its high sulfur, nitrogen, and ash content which includes significant quantities of toxic (hazardous) impurities such as mercury, beryllium, and arsenic. These materials find their way into the environment during the combustion of coal and, thus, constitute a health hazard through atmospheric and food chain comsumption.

Physical separation of these constituents from coal is not satisfactory as, at best, only a portion of them are removed. Furthermore, flue gas scrubbing is not entirely satisfactory as a means for sulfur and hazardous metals removal as at the present stage of development such systems (primarily for sulfur emissions control) are about 75 percent efficient, large quantities of sludges are formed which present a disposal problem, and the cost for flue gas scrubbing is high. Since the quantity of low-sulfur coal is limited and coal is our major source of energy, new or improved technology must be developed for cleaning coal prior to combustion to supply the U.S. with a clean coal and, at the same time, reduce the pollution of our environment. This clean coal can be used directly as a solid fuel and as a raw material for producing gaseous and liquid fuels.

The problem associated with producing a clean coal can be solved by employing chemical separation processing. Our research has shown that the majority of the sulfur and the majority of the ash including such toxic or hazardous metals as beryllium, boron, and lead can be extracted directly from the coal by a hydrothermal process The three different classes of impurities—sulfur, nitrogen, and metal values—are found in coal in a variety of ways.

Sulfur occurs in coal chiefly in three forms: (1) inorganic, (2) sulfate, and (3) organic. A fourth form, elemental sulfur, is rare. Of the inorganic sulfur compounds, iron pyrite ($FeS_2$ with an isometric crystal form) and marcasite ($FeS_2$ with the orthorhombic crystal form) are the most common. Other inorganic sulfides, chalcopyrite — $CuFeS_2$, arsenopyrite — FeAsS, and stibnite — $Sb_2S_3$, have been found, but they are rare.

Of the two major inorganic sulfides pyrite is the most common. It is found in coal as macroscopic and microscopic particles as discrete grains, cavity fillings, fiber-bundles and aggregates. The concentrations of pyritic sulfur vary widely even within the same deposit. Normally, the concentration will vary from 0.2 to 3 percent (sulfur basis), depending on the location.

The most common sulfate sulfur is calcium sulfate. Sulfates or iron, copper, and magnesium may also occur, but they are not abundant. Normally coal contains less than 0.1 percent sulfate sulfur, although in heavily weathered coal, it may be such as 1 percent. Because of its normally low concentration, it is of little concern in air pollution.

The third form of sulfur most prevalent in coal is organic sulfur. Since this sulfur is part of and is linked to the coal itself, positive identification of the organic sulfur compounds has not been possible. However, it is usually assumed that organic sulfur is in one of the following forms:

1. Mercaptan of thiol, RSH
2. Sulfide or thio-ether RSR'
3. Disulfide, RSSR'
4. Aromatic systems containing the thiophene ring.

The sulfur could be present as $\delta$ — thiopyrone.

No definite relationship between the organic and pyritic sulfur contents of coal has been established. In typical U.S. coal, the organic sulfur has ranged from 20.8 to 83.6 percent of total sulfur and has had no mean value of 51.2 percent of the total sulfur. The variation of the organic sulfur content of a coal bed from top to bottom is usually small. Pyritic sulfur may vary greatly.

Nitrogen, like sulfur, is probably part of and linked to the coal. Eastern coals average about 1.4 percent nitrogen, but with a range of 0.7 to 2.5 percent.

Metal values make up the part of coal commonly referred to as ash. They are found in coal as macroscopic and microscopic particles as discrete particles, cavity fillings, and aggregates. Concentration ranges from a few percent to 15 or 20 percent.

In addition to being a source of particulate emissions to the atmosphere, ash can give rise to operating problems. For example, excessive spalling and fluxing of refractories have been associated with the presence of sodium in the fuel. Quality of product may be adversely affected by ash from the flame, while build-up of deposits of ash on furnace tubes can reduce the rate of heat transfer. In addition, some types of deposits in the molten state may cause severe corrosion.

SUMMARY OF THE INVENTION

A typical method according to the present invention for extracting a substantial proportion of the pyritic, organic, and sulfate sulfur compounds and ash present in a solid carbonaceous fuel of the coal or coke type comprises mixing the fuel with an aqueous alkaline solution containing a sodium, calcium, or ammonium carbonate, hydroxide, sulfide, or hydrosulfide, or a plurality thereof, heating the resulting mixture to at least about 125° C at a pressure of at least about 25 psig to leach out said sulfur compounds and ash, separating the easily removable leached out materials from the remainder of the fuel, and washing said remainder of the fuel.

The concentration of alkali in the solution typically is about 1 to 35 percent by weight, and the mixture typically is heated for at least about 5 minutes at about 350° C, about 1 hour at 300° C, about 2 hours at 250° C, about 4 hours at 200° C, about 10 hours at about 125° C, or for at least a time approximately proportionately between the foregoing times at an intermediate temperature. The pressure may be provided at least in part by oxygen, hydrogen, nitrogen, oxygen plus nitrogen, or hydrogen plus nitrogen, or hydrogen plus nitrogen.

The method may be carried out either in a batchwise fashion or in a substantially continuous operation. Where the extraction is to be substantially continuous the method typically comprises the steps of continuously introducing the fuel at a preselected rate into the aqueous alkaline solution to form a slurry, moving the slurry through a region maintained at the elevated temperature and pressure to leach out the sulfur compounds and ash, moving the slurry outside the leaching region and separating the easily removable leached out materials from the remainder of the fuel by filtering, moving said remainder of the fuel away from the separated leached out materials and washing said remainder.

The resulting solution containing the leached out materials typically is regenerated by removing the leached out materials therefrom and is recycled as the liquid aqueous medium in the continuous process.

DESCRIPTION OF PREFERRED EMBODIMENTS

A typical method according to the present invention for extracting a substantial proportion of the pyritic, organic, and sulfur compounds and ash present in a solid carbonaceous fuel of the coal or coke type comprises mixing the fuel with an aqueous alkaline solution containing a sodium, calcium, or ammonium carbonate, hydroxide, sulfide, or hydrosulfide, or a plurality thereof (e.g., sodium hydroxide, ammonium sulfide, calcium hydrosulfide, or sodium carbonate; or sodium hydroxide and ammonium hydroxide), heating the resulting mixture to at least about 125° C at a pressure of at least about 25 psig to leach out said sulfur compounds and ash, separating the easily removable leached out materials from the remainder of the fuel, and washing said remainder of the fuel.

The concentration of alkali in the solution typically is about 1 to 35 percent by weight, and the mixture typically is heated for at least about 5 minutes at about 350° C, about 1 hour at 300° C, about 2 hours at 250° C, about 4 hours at 200° C, about 10 hours at about 125° C, or for at least a time approximately proportionately between the foregoing times at an intermediate temperature. The pressure may be provided at least in part by oxygen, hydrogen, nitrogen, oxygen plus nitrogen, or hydrogen plus nitrogen.

The method may be carried out either in a batchwise fashion or in a substantially continuous operation. Where the extraction is to be substantially continuous, the method typically comprises the steps of continuously introducing the fuel at the preselected rate into the aqueous alkaline solution to form a slurry, moving the slurry through a region maintained at the elevated temperature and pressure to leach out the sulfur compounds and ash, moving the slurry outside the leaching region and separating the easily removable leached out materials from the remainder of the fuel by filtering, moving said remainder of the fuel away from the separated leached out material, and washing said remainder. The resulting solution containing the leached out materials typically is regenerated by removing the leached out materials therefrom by filtration and is recycled as the liquid aqueous medium in the continuous process.

The approach which has met with success in the present invention for removing impurities from coal is known as the hydrothermal process. As the name implies, hydrothermal processing involves the application of the principles of aqueous chemistry and heat to achieve the desired goal whether it be the precipitation or the solubilization of a material. The process may be operated batchwise or continuously as desired.

Hydrothermal processing encompasses pressure leaching and pressure hydrolysis (pressure precipitation). In pressure leaching, an aqueous slurry of the material to be beneficiated (purified) is heated in an autoclave to selectively extract the impurities. Reaction conditions such as temperature, pressure (steam pressure plus any overpressure resulting from the addition of an inert, reducing, or oxidizing gas), pH, slurry concentration and retention time are important in the extraction of the impurities.

Pressure leaching is employed in this invention for the removal of impurities from coal. The coal, after washing or directly from the mine, i.e., unwashed, is crushed to the desired particle size and leached in an autoclave to extract the sulfur and ash values. After removal of the leach liquor, i.e., the filtrate containing the impurities (leached out materials), the leached coal is washed to remove the absorbed liquor and dried. The filtrate is regenerated and recycled to the process.

In addition to the removal of the impurities from coal, the reactivity of the coal may be greatly increased due to the fact that the coal structure is opened by (1) the removal of the pyritic sulfur from between the layers of coal, (2) disruption of the coal structure during the removal of the organic sulfur, and (3) swelling of the coal as a result of the elevated temperature and penetration of the coal structure by the hot water, steam, and the leachant.

The temperature at which the extraction is carried out, typically is within the range of about 125° to 350° C, and preferably within the range of about 125° to 250° C. Reaction time may also vary over a wide range and it is obvious that the exact time period depends upon such factors as temperature, particle size, and alkali concentration. In general, the reaction is carried out for about 5 minutes to 10 hours or more. The use of ground or crushed coal is preferred in order to facilitate the reaction.

A continuous, closed-loop process can be used for the commercial production of clean coal. By this process, the slurry of the coal and the leachant is pumped continuously through a heated reactor to selectively extract the impurities. The product after separation from the product slurry is processed as described above, and the leachant then is regenerated for recycle to the system.

Using, for example, caustic soda as the leachant, the aqueous medium contains sulfur compounds such as $Na_2S$, NaHS, possibly $Na_2S_x$, and sodium derivatives of the organic sulfides and soluble ash values. Regeneration of the leachant for recycle and recovery of the sulfur values as elemental sulfur is achieved by first treating the solution with steam to remove the organic sulfur compounds. Sulfur is recovered from these by hydrogen reduction to produce $H_2S$, which is readily converted to elemental sulfur by the Claus reaction. The organic compounds may be of commercial value. Treatment of the remaining solution with $CO_2$ releases the remaining sulfur as $H_2S$, converts the sodium values to $NaHCO_3$, and precipitates extracted ash values such as alumina. The $H_2S$ is combined with that from the reduction of the organic sulfides and is converted to elemental sulfur by the Claus reaction. Treatment of the aqueous carbonate solution with lime converts the $NaHCO_3$ to NaOH for recycle and to $CaCO_3$. The $CaCO_3$ is thermally decomposed to CaO and $CO_2$ which is then recycled to the system. By this scheme, recycle of all chemicals is achieved, coal is converted to low sulfur, low ash fuel, and sulfur is recovered in the elemental form.

In accordance with this invention it has been found that low sulfur, low ash coal can be prepared by leaching coal in aqueous alkaline media in an autoclave.

Approximately 50 percent of the organic sulfur, 100 percent of the pyritic sulfur, and approximately 70 percent of the sulfate sulfur were leached from a washed Ohio coal using sodium hydroxide as the leachant. This work involved heating a ground coal, 70 percent minus 200 mesh, in caustic solutions at 200° to 250° C for 2 hours, after which the slurries were cooled to approximately 90° C and filtered. The resulting cake (leached coal) was washed by displacement washing and dried for analysis. The final coal product contained 0.97 percent total sulfur (0.04 percent sulfate sulfur and 0.93 percent organic sulfur). The original (washed) coal contained 5.18 percent total sulfur —3.28 percent pyritic sulfur, 1.78 percent organic sulfur, and 0.12 percent sulfate sulfur.

Similar results were obtained with an unwashed Ohio coal, i.e., directly from the mine. This coal contained 7.4 percent total sulfur of which 1.6 percent was organic sulfur. The remainder was pyritic and sulfate sulfur. resulted in the removal of approximately 40 percent of the organic sulfur and 96.5 percent of the pyritic and sulfate sulfur. The final product contained 1.2 percent sulfur (1.0 percent organic sulfur and 0.2 percent pyritic and sulfate sulfur). In both cases, the final leached product was a free flowing coal powder showing no signs of plastic deformation.

In addition to removing the sulfur, other recent results reveal that the ash including such toxic or hazardous metals as beryllium, lead, chromium, arsenic, manganese, and boron can be extracted. This results in a clean coal suitable for use as a fuel in power plants and as a raw material for the production of gaseous and liquid fuels and other carbonaceous products requiring high quality raw materials.

Desulfurization of coal using an aqueous medium was also performed in a continuous reactor whereby a slurry of coal and aqueous medium was pumped in one end of the reactor and the slurry containing the leached coal was removed at the other end.

The feed slurry was made up of 150 g of coal, ground to minus 325 mesh, and 750 ml of an aqueous sodium hydroxide solution containing 150 g/l of sodium hydroxide. Reactor operating conditions were:

1. Temperature at 250° C
2. Pressure at 600 psig, and
3. Residence time of 14 minutes.

Under these conditions, the sulfur level was reduced from its original value of 5.18 percent to 2.47 percent, giving an overall extraction efficiency of 52.3 percent.

Additional illustrative examples of the applicability of this invention for the extraction of sulfur from coal are shown in Tables 1, 2, and 3. As discussed previously, the sulfur is leached from the coal by heating said coal in an aqueous alkaline medium at a preselected temperature for a preselected time. It is noted as shown in Table 1 that 67.4 to 81.3 weight percent of the total sulfur content of a strip-mined bituminous coal is removed by pressure leaching, using aqueous caustic (NaOH) solution as the leachant.

The total sulfur content was reduced from 5.18 percent to 0.97 percent by using a two-stage leaching process — HCL leach followed by a NaOH leach.

TABLE I

EXTRACTION OF SULFUR FROM COAL[1]

| Run Number | Charge Makeup: Coal, g | Charge Makeup: $H_2O$, ml | Charge Makeup: NaOH or HCl g/l | Conditions: Temp., ° C | Conditions: Press., psig | Conditions: Time, hr. | Residue weight, g | Results: Sulfur (Before) % | Results: Sulfur (After) % | Results: Extraction Efficiency % |
|---|---|---|---|---|---|---|---|---|---|---|
| 1 | 300 | 1500 | NaOH-150g | 250 | 480 a | 2.0 | 306.0 | 5.18 | 1.11 | 78.6 |
| 2 | 300 | 1500 | NaOH-75g | 250 | 460 | 2.0 | 281.3 | 5.18 | 1.69 | 67.4 |
| 3 | 300 | 1500 | NaOH-300g | 250 | 470 | 2.0 | 281.5 | 5.18 | 1.59 | 69.3 |
| 4 | 300 | 1500 | HCl-75g | 200 | 200 | 2.0 | — | 5.18 | 5.31 | — |
| 5[2] | 300 | 1500 | NaOH-150g | 250 | 480 | 2.0 | 303.4 | 5.18 | 0.97 | 81.3 |

[1]Coal (as received) contained 3.28 percent pyritic sulfur, 0.12 percent sulfate sulfur and 1.78 percent organic sulfur (by difference). Total sulfur content was 5.18 percent. Coal was washed prior to leaching.

[2]Acid leached residue from 4.

Leaching under similar conditions as described above

TABLE 2

TYPE OF SULFUR EXTRACTED FROM OHIO WASHED COAL

Analyses of Leached Coal Samples [1][2][3]

| Run No. | Pyritic Wt. % | Pyritic % Ext. | Sulfate S Wt. % | Sulfate S % Ext. | Organic S Wt. % | Organic S % Ext. | Total S Wt. % | Total S % Ext. |
|---|---|---|---|---|---|---|---|---|
| 1 | 0.02 | 99.5 | 0.08 | 33.3 | 1.02 | 42.7 | 1.11 | 78.6 |
| 5 | <0.01 | 100 | 0.04 | 66.7 | 0.93 | 49.2 | 0.97 | 81.3 |

TABLE 2-continued

| TYPE OF SULFUR EXTRACTED FROM OHIO WASHED COAL Analyses of Leached Coal Samples [1][2][3] | | | | | | | | |
|---|---|---|---|---|---|---|---|---|
| | Pyritic | | Sulfate S | | Organic S | | Total S | |
| Run No. | Wt. % | % Ext. | Wt. % | % Ext. | Wt. % | % Ext. | Wt. % | % Ext. |
| 6 | 0.97 | 70.6 | 0.45 | — | 1.32 | 25.9 | 2.74 | 47.1 |

[1]Leaching conditions:
a. Temp. — 250 C
b. Time — 2 hr
c. NaOH concentration, g/l, respectively — 100, 100, and 25.8
d. Coal to NaOH weight ratio, g, respectively — 2:1, 2:1, and 7.8:1.
[2]Analysis of coal (wt. %) as received:
Total sulfur — 5.18
Pyritic sulfur — 3.28
Sulfate sulfur — 0.12
Organic sulfur (by difference) — 1.78.
[3]Wt. % — percent of that sulfur found in the leached coal.

TABLE 3

| TYPE OF COAL VERSUS DEGREE OF EXTRACTION | | | | | | |
|---|---|---|---|---|---|---|
| | Reagent | | | | S in Product, percent | |
| Run Number | Composition | gm. per gm. coal | Temp., ° C | Time, min | Total | Organic |
| 7 | NaOH | 0.55[a] | 250 | 120 | 1.2 | 1.0 |
| 8 | NaOH | 0.13[a] | 340 | 60 | 1.2 | 0.9 |
| 9 | NaOH | 0.13[b] | 250 | 120 | 2.7 | 1.3 |
| 10 | NaOH | 0.13[b] | 250 | 240 | 3.1 | 1.3 |
| 11 | $NH_3$ | 0.28[b] | 250 | 120 | 4.5 | 1.7 |
| 12 | $H_2$+NaOH[c] | 0.3+0.13[b] | 250 | 12 | 3.5 | 1.6 |

[a]Coal unwashed, −200 mesh, 14.0% ash, 7.4% tot. S, 1.6% org. S.
[b]Coal from O.S.U. Powerhouse, −200 mesh, 5.2% tot. S., 1.8% org. S.
[c]In all cases, water was provided at the rate of 5 ml/gm coal.

The acid leach did not remove any sulfur, but rendered the coal more amenable to attach by the NaOH. A one-stage extraction using 10 percent caustic as the leachant reduced the sulfur content to 1.11 percent. The sulfur values were extracted as a water soluble sulfur compound, probably $Na_2S$; thus the sulfur value is recoverable from the leachant as $H_2S$ or as elemental sulfur. The liquors also contained organic compounds which may be of commercial value.

From analyses of selected leached coal samples (Table 2) it is observed that essentially 100 percent of the pyritic sulfur, 33.3 to 66.7 percent of the sulfate sulfur, and 42.7 to 49.2 percent of the organic sulfur was extracted from a bituminous coal by pressure leaching of the coal (ground to approximately 70 percent minus 200 mesh) at 250° C (pressure of 480 psig) for 2 hours in 10 percent sodium hydroxide solutions.

These products were prepared by heating ground coal, having a particle size of about 70 percent minus 200 mesh, in aqueous caustic solutions at 200° to 250° C for 2 hours. Then the slurries were cooled to approximately 90° C and filtered. The resulting filter cake was washed by displacement washing with water and dried at 80° C for 16 hours.

Additional support data are shown in Table 3 where it is noted that total sulfur content was lowered from 7.4 percent to 1.2 percent resulting in an extraction efficiency of 84 percent. Organic sulfur content was reduced to 0.9 percent, a 56 percent removal. Pyritic and sulfate sulfur was lowered to 0.3 percent which represents an extraction efficiency of 95 percent.

While the forms of the invention herein disclosed constitute presently preferred embodiments, many others are possible. It is not intended herein to mention all of the possible equivalent forms of ramifications of the invention. It is to be understood that the terms used herein are merely descriptive rather than limiting, and that various changes may be made without departing from the spirit or scope of the invention.

We claim:

1. A method of extracting a substantial proportion of the pyritic, organic, and sulfate sulfur compounds and ash present in a solid carbonaceous fuel of the coal or coke type comprising mixing the fuel with an aqueous alkaline solution containing a sodium, calcium, or ammonium carbonate, or a calcium or ammonium hydroxide, sulfide, or hydrosulfide, or a plurality thereof, heating the resulting mixture to at least about 125° C at a pressure of at least about 25 psig to leach out said sulfur compounds and ash, separating the easily removable leached out materials from the solid remainder of the fuel, and washing said remainder of the fuel.

2. A method as in claim 1, wherein the concentration of alkali in the solution is about 1 to 35 percent by weight.

3. A method as in claim 1, wherein the mixture is heated for at least about 5 minutes at about 350° C, about 1 hour at 300° C, about 2 hours at 250° C, about 4 hours at 200° C, about 10 hours at about 125° C, or for at least a time approximately proportionately between the foregoing times at an intermediate temperature.

4. A method as in claim 1, wherein the mixture is heated at a pressure provided at least in part by oxygen, hydrogen, nitrogen, oxygen plus nitrogen, or hydrogen plus nitrogen.

5. A method as in claim 1, wherein the extraction is substantially continuous, comprising the steps of continuously introducing the fuel at a preselected rate into the alkaline solution to form a slurry, moving the slurry through a region maintained at the elevated temperature and pressure to leach out the sulfur compounds and ash, moving the slurry outside the leaching region and separating the easily removable leached out materials from the remainder of the fuel by filtering, moving said remainder of the fuel away from the separated leached out materials, and washing said remainder.

6. A method as in claim 5, wherein the resulting solution containing the leached out materials is regenerated by removing the leached out materials therefrom and is recycled as the liquid aqueous medium in the continuous process.

7. A method of substantially continuously extracting a substantial proportion of the pyritic, organic, and sulfate sulfur compounds and ash present in a solid carbonaceous fuel of the coal or coke type comprising continuously introducing the fuel at a preselected rate into an aqueous alkaline solution containing a sodium, calcium or ammonium carbonate, hydroxide, sulfide, or hydrosulfide, or a plurality thereof, so as to form a slurry, heating the resulting slurry to at least about 125° C at a pressure of at least about 25 psig, moving the slurry through a region maintained at the elevated temperature and pressure to leach out the sulfur compounds and ash, moving the slurry outside the leaching region and separating the easily removable leached out materials from the remainder of the fuel, moving said remainder of the fuel away from the separated leached materials, and washing said remainder.

8. A method as in claim 7 wherein the slurry is pumped continuously through a heated reactor to selectively extract the impurites.

9. A method as in claim 7 wherein the easily removable leached out materials are separated from the remainder of the fuel by filtering.

10. A method as in claim 7, wherein the concentration of alkali in the solution is about 1 to 35 percent by weight.

11. A method as in claim 7, wherein the slurry is heated for at least about 5 minutes at about 350° C, about 1 hour at 300° C, about 2 hours at 250° C, about 4 hours at 200° C, about 10 hours at about 125° C, or for at least a time approximately proportionately between the foregoing times at an intermediate temperture.

12. A method as in claim 1, wherein the slurry is heated at a pressure provided at least in part by oxygen, hydrogen, nitrogen, oxygen plus nitrogen, or hydrogen plus nitrogen,

13. A method of extracting a substantial proportion of the pyritic, organic, and sulfate sulfur compounds and ash present in a solid carbonaceous fuel of the coal or coke type comprising mixing the fuel with an aqueous alkaline solution containing a sodium, calcium, or ammonium carbonate, hydroxide, sulfide, or hydrosulfide, or a plurality thereof, heating the resulting mixture to at least about 125° C at a pressure of at least about 25 psig to leach out said sulfur compounds and ash, separating the solution containing the easily removable leached out materials from the solid remainder of the fuel, washing the remainder of the fuel, regenerating the solution by removing the leached out materials therefrom, and recycling the regenerated solution for use as said aqueous medium.

14. A method as in claim 12, wherein the easily leached out materials are separated from the remainder of the fuel by filtering.

15. A method of extracting a substantial proportion of the pyritic, organic, and sulfate sulfur compounds and ash present in a soiid carbonaceous fuel of the coal or coke type comprising mixing the fuel with an aqueous alkaline solution containing a sodium, calcium or ammonium carbonate, hydroxide sulfide, or hydrosulfide, or a plurality thereof, heating the resulting mixture to at least about 125° C at a pressure of at least about 25 psig to leach out said sulfur compounds and ash, filtering the mixture to separate the easily removable leached out materials from the solid remainder of the fuel, and washing said remainder of the fuel.

16. A method as in claim 1, wherein the concentration of alkali in the solution is about 1 to 35 percent by weight.

17. A method as in claim 1, wherein the mixture is heated for at least about 5 minutes at about 350° C, about 1 hour at 300° C, about 2 hours at 250° C, about 4 hours at 200° C, about 10 hours at about 125° C, or for at least a time approximately proportionately between the foregoing times at an intermediate temperature.

18. A method as in claim 1, wherein the mixture is heated at a pressure provided at least in part by oxygen, hydrogen, nitrogen, oxygen plus nitrogen, or hydrogen plus nitrogen.

* * * * *